United States Patent [19]

Nguyen et al.

[11] Patent Number: 4,774,915

[45] Date of Patent: Oct. 4, 1988

[54] STARTING UNIT FOR AN INTERNAL COMBUSTION ENGINE

[75] Inventors: Huu-Can Nguyen, Rueil Malmaison; Jean-Charles Sarbach, Maisons-Alfort, both of France

[73] Assignee: Valeo, Paris, France

[21] Appl. No.: 46,198

[22] Filed: May 5, 1987

[30] Foreign Application Priority Data

May 16, 1986 [FR] France ..... 86 07054

[51] Int. Cl.[4] ..... F02N 17/00

[52] U.S. Cl. ..... 123/179 B; 123/179 M; 74/7 R

[58] Field of Search ..... 123/179 B, 179 M; 74/7 R, 339, 7 A; 290/38 R, 38 C, 38 B, 38 A, 38 E

[56] References Cited

U.S. PATENT DOCUMENTS

| | | | |
|---|---|---|---|
| 2,302,680 | 11/1942 | Dyer | 290/37 |
| 4,319,139 | 3/1982 | Mazzorana | 74/9 |
| 4,543,923 | 10/1985 | Hamano et al. | 123/179 M |
| 4,551,630 | 11/1985 | Stahura et al. | 123/179 B |
| 4,586,467 | 5/1986 | Raver | 123/179 B |

OTHER PUBLICATIONS

Patents Abstracts of Japan, vol. 7, No. 177 (M-233) [1322], Aug. 5, 1983; Mitsubishi Denki K.K.

*Primary Examiner*—James C. Yeung

*Attorney, Agent, or Firm*—Cushman, Darby & Cushman

[57] ABSTRACT

The starting unit comprises start-up means for the engine, comprising: engagement means capable of being displaced in translation for engagement in complementary receiving means linked to the engine; actuating means for displacing the engagement means in translation; and drive means capable of driving the start-up means. The unit comprises sensor means responsive to the relative position of the engagement means and of the receiving means; angular incrementation means capable of causing the engagement means to rotate in relation to the receiving means by a predetermined amplitude; and control means sensing the indications supplied by the sensor means and capable, on the one hand, of limiting the translational movement of the engagement means when these means do not occupy a correct position, an angular incrementation then being effected, and, on the other hand, of ensuring the engagement of the engagement means in the receiving means only when a correct position has been reached, and only then starting the drive means if the start-up of the engine is desired by the user.

17 Claims, 4 Drawing Sheets

STARTING UNIT FOR AN INTERNAL COMBUSTION ENGINE

FIELD OF THE INVENTION

The invention relates to a starting unit for an internal combustion engine. Such unit being of the kind which comprises start-up means for starting the engine and containing: engagement means capable of being displaced in translation to be engaged in complementary receiving means linked in rotation to the internal combustion engine and to be released therefrom; actuating means for displacing said engagement means in translation, said actuating means comprising a rotary drive source and motion transformation means for converting a rotational motion into a translational motion; and drive means capable of driving the start-up means in rotation for driving the internal combustion engine when the engagement means have been engaged in said complementary receiving means.

PRIOR ART

Such starting units, wherein the actuating means comprise a rotary drive source, make it possible to exercise a better control, for meshing of the engagement means with the complementary receiving means during the travel of the engagement means, over the forces developed and the travel than in the case where the actuating means are constituted by a solenoid. Moreover, the energy consumption of the actuating means comprising a rotary drive source is lower than in the case of a solenoid.

There nevertheless remains the fact that meshing of the engagement means in the receiving means is not effected in a completely satisfactory manner. Generally, the engagement means comprise a pinion, whilst the receiving means are the grooves of a crown wheel. It only happens exceptionally that the teeth of the pinion are opposite the grooves of the crown wheel, so the engagement is generally effected under difficult mechanical conditions with a "milling" effect of the pinion on the crown wheel and premature wear of these components. This also generates considerable noise. It may, moreover, be noted that the drive means, which are generally constituted by an electric motor of relatively high power, have so far not been effectively protected; for example, if a user maintains the electrical contact at the starter switch too long during starting, the drive means can be driven along at excessive speed by the internal combustion engine following a succession of ejections of the pinion from the crown wheel, and subsequent returns of the pinion into mesh with the crown wheel.

OBJECT OF THE INVENTION

The principal object of the invention is to provide a starting unit for an internal combustion engine of the kind defined above which would meet the various practical requirements better than heretofore and which would, in particular, no longer have the drawbacks mentioned above, or would do so only to a lesser extent.

SUMMARY OF THE INVENTION

In accordance with the invention, a starting unit for an internal combustion engine comprises:

sensor means responsive to the relative position of the engagement means and of the complementary receiving means;

angular incrementation means, capable of causing the engagement means to rotate relative to the receiving means by a predetermined amplitude;

and control means responsive to the indications provided by the sensor means and capable, on the one hand, of limiting the translational movement of the engagement means when it is apparent that these engagement means do not occupy a correct position in relation to the receiving means and allowing an angular incrementation to be effected and, on the other hand, of ensuring the meshing of the engagement means with the receiving means when a correct position is reached and only then starting the drive means if start-up of the internal combustion engine is desired by the user.

The engagement of the engagement means and of the receiving means is thus controlled. This results in a substantial reduction in the wear of these components and a reduction in noise.

Preferably the control means are combined with means sensing the operation of the internal combustion engine and are arranged to actuate the engagement of the engagement means and of the complementary receiving means only when the internal combustion engine is at rest.

Thus, when the user actuates a start, meshing of the engagement means with the complementary receiving means will already have been obtained.

The means sensing the operation of the internal combustion engine can be a detector responsive to the speed of rotation of this engine, the data supplied by this detector being sent to the control means.

Generally, the control means are capable of withdrawing the engagement means opposite the receiving means if an incorrect position has been detected, then after an angular incrementation of these engagement means, a fresh advance of the latter and so on until a correctly meshed position is reached.

Advantageously, the drive means are activated by a switch which is subject to the influence of the control means independently of the actuating means.

The control means can stop the drive means when the speed of rotation of the internal combustion engine detected by the sensor exceeds a predetermined value. Provision can moreover be made for means limiting the temperature of the drive means to stop the drive means if necessary.

Generally, as set out above, the engagement means comprise a pinion whilst the receiving means comprise a crown wheel whose grooves between the teeth are capable of receiving the teeth of the pinion; the sensor means preferably comprise means sensing the coming into contact of the teeth of the pinion against those of the crown wheel during the approach movement, when the teeth of the pinion are not located opposite the grooves of the crown wheel.

These tooth-tooth contact sensing means are advantageously constituted by an electronic stepper motor or an equivalent device constituting the rotary drive source of the actuating means, this electric motor being of the type operated by pulses applied to the stator, which pulses normally entail an angular displacement of the rotor, this type of motor comprising means for detecting whether the rotor has executed the rotational movement corresponding to the pulses supplied to the stator or not. It will be immediately understood that with such a rotary drive source, the pinion can no longer be displaced in translation when the teeth of the pinion have come into contact against those of the crown wheel and hence the rotor of the electronic switching motor or equivalent device can no longer turn, in spite of the pulses sent to the stator. This absence of rotation therefore makes it possible to detect that the teeth of the pinion have come into contact.

The means transforming the rotational motion of the rotary drive source comprise a screw-nut system, one of these elements being driven in rotation whilst being secured against translation, whilst the other element is secured against rotation and free for translation.

In accordance with a first group of embodiments, the actuating means are separate from the start-up means and provision is made for a mechanical linkage system, in particular of the lever and fork type, for transmitting the translational motion established by the actuating means to the start-up means.

The angular incrementation means can be mechanical and comprise a system with an inclined ramp and ball, or equivalent, capable of transforming a translational motion between two elements into a rotational motion. These angular incrementation means can comprise a sleeve linked in translation to the pinion and comprising on its external surface, at least one inclined ramp, whilst a ring, secured in rotation, is mounted for translation on this sleeve, there being resilient means between the sleeve and the ring to oppose their relative displacement in translation; the ball or balls intended to cooperate with the ramp or ramps of the sleeve are carried internally by the ring; the linkage of the sleeve and the pinion in rotation is ensured by a freewheel for a given direction of rotation corresponding to the direction of locking the freewheel, whilst in the other direction the sleeve can rotate freely in relation to the pinion; the translational movements actuated by the actuating means are transmitted to the ring, and the assembly is such that displacement of the ring in relation to the sleeve when the teeth of the pinion come to bear against the crown wheel teeth, produces rotation of the sleeve in the direction wherein the freewheel does not transmit the rotational motion to the pinion, whilst when the ring is withdrawn under the effect of the elastic means, the rotational motion which is produced in the opposite direction is transmitted by the freewheel to the pinion so as to ensure the angular incrementation.

In another possibility, this angular incrementation can be obtained by means of a stepping type of electric motor whose stator is connected to the mounting of the drive means and whose rotor is linked in rotation to the pinion.

In a second group of embodiments, the actuating means can be incorporated with the start-up means; the rotary drive source of these actuating means is constituted by an electronic switching motor, or an equivalent device, whose stator is fixed to the mounting of the drive means whilst the rotor which is free for rotation but secured against translation in relation to this body forms a nut with an internal thread capable of cooperating with the external thread of a ring, secured against rotation but which is free for translation.

The angular incrementation means can be formed by a mechanical system of an inclined ramp and ball type; the inclined ramp or ramps are provided on the external surface of a sleeve which is accommodated within the ring and capable of translational displacement in relation to this ring against the resilient means, whilst the ball or balls are carried inside the ring, the sleeve being linked for rotation to the pinion by a freewheel capable of ensuring the transmission of the rotational motion from the sleeve to the pinion when the ring is withdrawn.

As a variant, the angular incrementation means can be constituted by an electronic switching type electric motor, the stator of this motor being linked to the mounting of the drive means whilst the rotor is linked for rotation and translation to the pinion.

The transmission of the rotational motion of the drive means to the start-up means is effected by a freewheel.

The control means are constituted by an electronic motor capable of forming the control signals according to the various data received.

BRIEF DESCRIPTION OF THE DRAWINGS

Apart from the various objects and advantages set out above, the invention consists of other features which will be discussed in greater detail below in relation to particular embodiments described in detail with reference to the attached drawings but which are in no way restrictive.

Finally.

DESCRIPTION OF THE PREFERRED EMBODIMENTS

Figure 1:
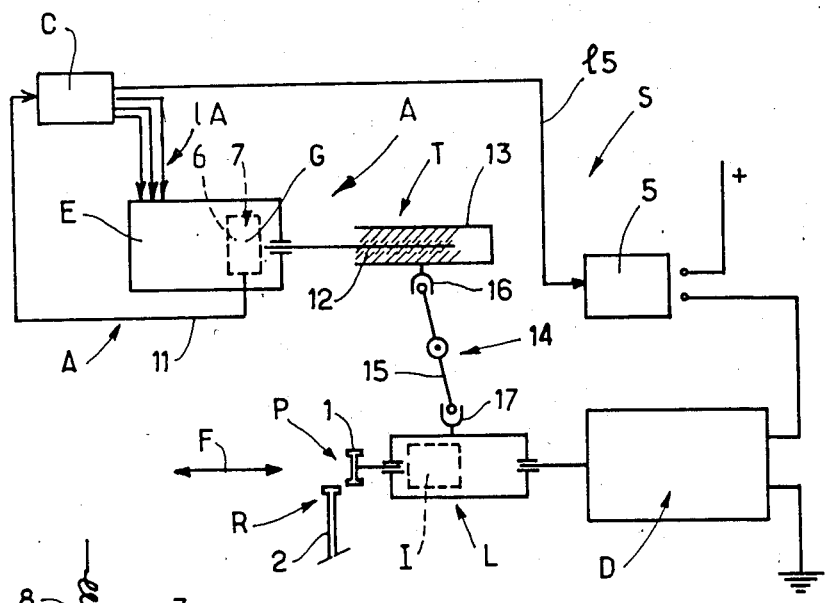
FIG. 1 of these drawings is a simplified diagram of a starter in accordance with the invention wherein the actuating means are separate from the drive means.

Referring to the drawings, in particular to FIG. 1, there can be seen a starting unit S for an internal combustion engine (not shown), in particular for motor vehicles, comprising:

start-up means L for the internal combustion engine, these start-up means comprising engagement means P capable of being displaced in translation along a direction represented by the double arrow F for engagement with the complementary receiving means R, linked for rotation with the internal combustion engine, or of being released from these receiving means R;

actuating means A for the translational displacement of the engagement means P, these actuating means A comprising a rotary drive source E and means T for transforming a rotational motion into a translational motion;

and drive means D capable of driving the start-up means L in rotation to ensure the rotational drive of the internal combustion engine when the engagement means P are engaged with the receiving means R.

Figure 11:
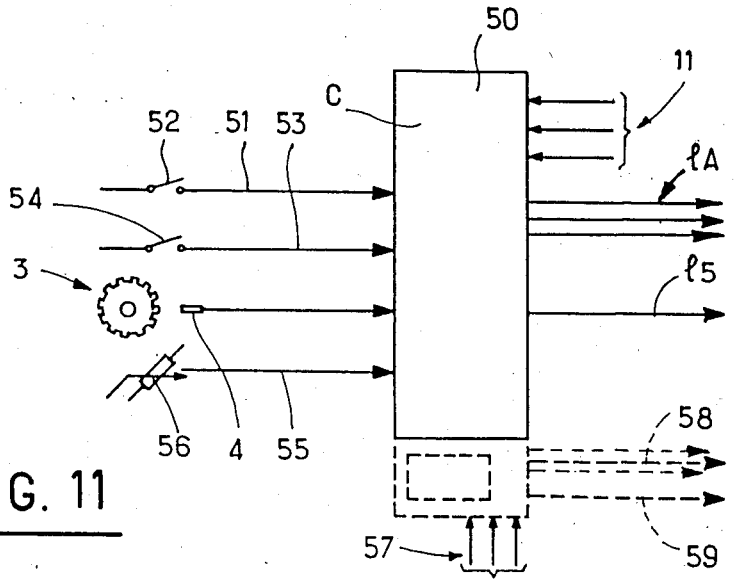
FIG. 11 is a layout diagram of the control means of the starting unit.

In accordance with the invention, the starting device S comprises:

sensor means G for sensing the relative position of the engagement means P and of the receiving means R;

angular incrementation means I capable of causing the engagement means P to rotate in relation to the receiving means R by a predetermined amplitude; and control means C represented in greater detail in FIG. 11, for sensing the indications supplied by the sensor means G and capable of on the one hand limiting the translation of the engagement means P when it is apparent that they are not in the correct position in relation to the receiving means R and, on the other hand, ensuring the engagement of the engagement means P with the receiving means R when a correct position has been attained and only then starting the drive means D if the start-up of the internal combustion engine is desired by the user.

Generally, the engagement means P comprise a pinion 1 whilst the receiving means R comprise a crown wheel 2 whose grooves between the peripheral teeth are capable of receiving the teeth of the pinion 2. This crown wheel 2, schematically and partly represented in FIG. 1, is secured for rotation on the crank shaft of the internal combustion engine.

The control means C are, as may be seen in FIG. 11, combined with means 3 sensing the operation of the internal combustion engine, these means 3 being advantageously formed by a detector 4 sensing the rotational speed of the engine. The detector 4 is of a conventional type comprising a cog wheel fixed to the shaft of the engine and a detector detecting the passing of the teeth of the cog wheel. The control means C are arranged so as to actuate the operation of the actuating means A in order to ensure the engagement of the pinion 1 in the crown wheel 2 when the detector 4 has sensed that the internal combustion engine has stopped, that is to say, when a zero rotational speed has been indicated by the detector 4.

The drive means D comprise a relatively high power electric motor to drive the internal combustion engine; the starting unit S comprises, for starting the drive meas D, an electromagnet type contactor 5 (FIG. 1) which is subject to the influence of the control means C independently of the actuating means A. In other words, the opening or closing of the contactor 5 is effected on the basis of instructions originating solely from the control means C.

One terminal of the electric motor forming the drive means D is connected to the chassis whilst the other terminal is connected by means of the contactor 5 to the + terminal of the vehicle battery.

The sensor means G comprise means 6 sensing the coming into contact of the teeth of pinion 1 with those of the crown wheel 2 during the approach motion when the pinion teeth are not located opposite the grooves of the crown wheel.

Figure 3:
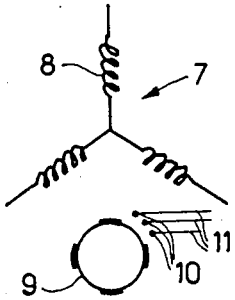
FIG. 3 is a diagram of an electronic switching motor intended to serve as the rotary drive source for the actuating means and the sensor means.

Advantageously, the sensor means 6 comprise an electronic stepper motor 7 or an equivalent device which constitutes the rotary drive source E of the actuating means A. As schematically represented in FIG. 3, such a motor comprises a stator 8 with several phases, a triphase in the example represented; the rotor 9 is of the permanent magnet type. Sensors 10, in particular Hall effect sensors, generally three in number, are provided for detecting the position of the rotor and generating the pulses sent to the phases of the stator 8. Thus, in such a motor 7, when the actuating pulses are applied to the windings of the stator 8, the rotor 9 must effect an angular displacement of a predetermined amplitude. The executions of this displacement is controlled by the sensors 10; if this rotation has not been executed, these sensors 10 supply an output indicating an absence of rotation, which indication is transmitted to the control means C by a line 11 (FIGS. 1 and 11). This is what happens when the pinion 1 abuts the crown wheel 2 because the teeth of this pinion are not opposite the grooves of the crown wheel 2; during this abutment, the pinion 1 can no longer be displaced in translation and the rotor 9, whose rotational movement is converted by the means T into a translational movement of the pinion 1, can no longer rotate.

The means T for transforming the rotational motion into translation comprise a screw/nut system, one of whose two elements is driven in rotation and secured in translation whilst the other is free for translation and secured against rotation.

In the embodiment of FIG. 1, the actuating means A are separate from the start-up means L; in that case, the screw 12 of the motion transformation means T is driven in rotation by the rotor 9 of the electric motor 7 without being capable of displacement in translation. The nut, secured against rotation but free for translation, cooperating with the screw is formed by a tapped socket 13. Provision is made for a mechanical linkage system 14 comprising in particular a lever 15, articulated in its central portion to a fixed pin, and forks 16, 17 for transmitting the translational movement of the socket 13 to the start-up means L.

Figure 2:
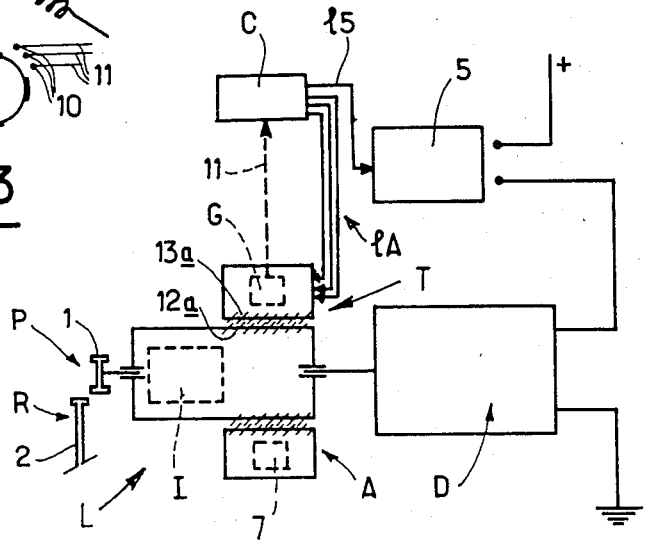
FIG. 2 is a diagram of another embodiment of the starting device in which the actuating means are incorporated with the start-up means.

In the embodiment of FIG. 2, the actuating means A are incorporated with the start-up means L. The screw **12*a* of the motion transformation means T is secured against rotation but can be displaced in translation, whilst the nut 13*a* which is directly linked to the rotor of the electric motor 7** is free for rotation but secured against translation.

Figure 4:
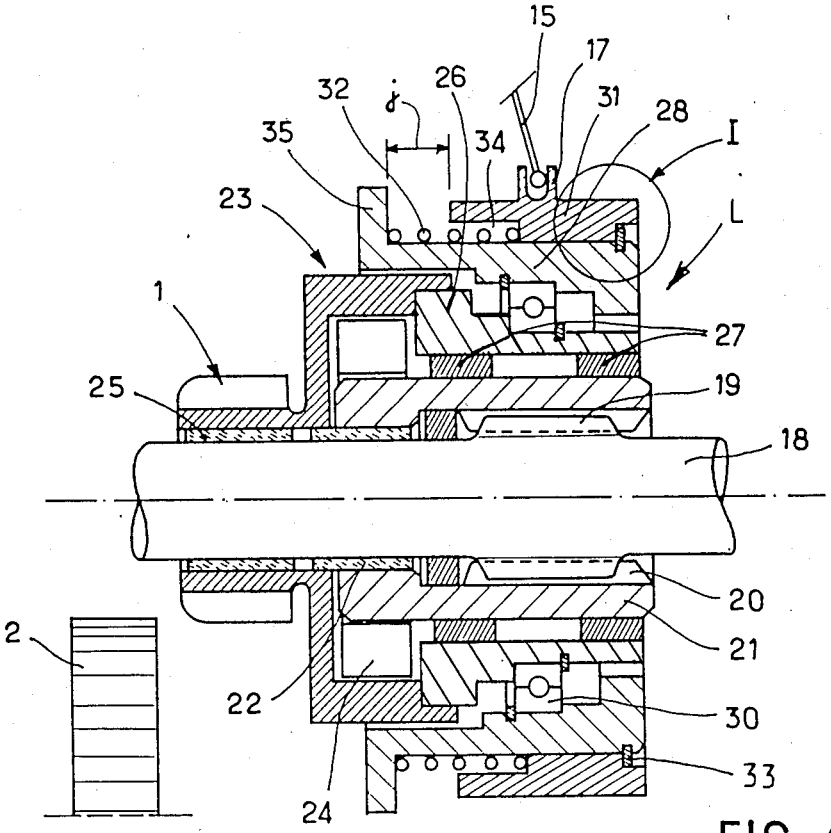
FIG. 4 is an axial cross-section of the start-up means and the angular incrementation means for the device of FIG. 1.

FIG. 4 illustrates an embodiment of the start-up means L combined with mechanical angular incrementation means for a starting device as shown in FIG. 1.

In FIG. 4, there may be seen the output shaft 18 of the drive means D which is caused to rotate by the electric motor constituting the starter proper when the contactor 5 is closed. This shaft 18 comprises at its periphery longitudinal teeth 19, parallel to the axial direction, capable of cooperating with complementary teeth 20 on the internal surface of a sleeve 21 mounted around the shaft 18 and free for translation relative thereto. Guidance of the sleeve 21 in relation to the shaft 18 can be ensured by plain bearings such as 22 provided between these two components. Coupling of the shaft 18 and the sleeve 21 in rotation is ensured by the cooperation of the teeth 19 and 20.

At its end facing the sleeve 21 the pinion 1 is fixed to the base of a cup 23 whose cylindrical skirt surrounds the end of the sleeve 21 at a certain radial distance therefrom. A freewheel transmission 24 is mounted between the internal surface of the cup 23 and the external surface of the end of the sleeve 21. This freewheel 24 is locked in the direction which ensures the driving of the cup 23 and of the pinion 1 by the shaft 18 when the shaft 18 is driven in rotation by the drive means D.

The pinion 1 is slidably mounted on the shaft 18 by means of a plain bearing 25.

The end of the cup 23 which is remote from the pinion 1 is detachably fixed, for instance by means of non-illustrated screws, to an extension sleeve 26 mounted free for rotation on the sleeve 21, for instance by means of plain bearings 27. The assembly formed by the sleeve 21, pinion 1, cup 23 and the sleeve 26 is integral in translation and is capable of displacement as a block along the axial direction of the shaft 18.

The mechanical angular incrementation means I comprise a sleeve 28 linked in translation with the sleeve 26 and hence to the pinion 1. This sleeve 28 comprises on its external surface at least one inclined ramp or groove such as 29 as may be seen in FIG. 5. The sleeve 28 is mounted on the sleeve 26 by means of a free wheel 30 or an equivalent device. The external and internal rings of this freewheel are linked in translation to the sleeve 28 and to the sleeve 26 respectively.

The direction wherein this freewheel 30 ensures the linkage in rotation of the sleeve 28 and of the pinion 1 will be indicated below.

The mechanical angular incrementation means I comprise, moreover, a ring 31 slidably mounted around the sleeve 26, this ring 31 is secured against rotation but can be driven in translation by the end of the lever 15 represented in FIG. 4, this lever 15 already having been described with reference to FIG. 1.

Resilient means such as a helical compression spring 32 are mounted around the sleeve 28 and urge the ring 31 against a circular split ring 33 anchored in a groove provided at the periphery of the sleeve 28. The ring 31 may comprise on its internal surface, on the side facing the pinion 1, an annular cut out intended to receive a portion of the spring 32. The sleeve 28 comprises, at its end facing the pinion 1, a flange 35 or equivalent projecting radially outwardly and serving as a stop for one of the ends of the spring 32. At least one ball 36 (FIG. 5) for cooperating with the ramp 29 is carried by the internal surface of the ring 31. This ball 36, which projects radially inwardly, is accommodated in a radially orientated bore 37 which opens towards the outside in a tapped hole 38 with a larger diameter. An externally threaded disc 39 is positioned in the hole 38 so as to keep the ball 36 projecting inwardly of the ring 21 in cooperation with the ramp 29.

Ramp 29 comprises a portion inclined in relation to the axial direction followed by a parallel extension h. The inclined portion of the ramp 29 is such that the translational displacement of the ring 31 in relation to the sleeve 8 entails, by the cooperation of the ball 36 and this inclined portion of the ramp 29, a relative rotation of a predetermined angular amplitude smaller than the angular clearance existing between the teeth of the pinion 1 and those of the crown wheel 2 when meshing is obtained. In practice, this clearance is of the order of 1/6 of the pitch of one tooth of the pinion 1. The incrementation pitch will therefore be equal to, or slightly less than, 1/6 of the pitch of one tooth of the pinion 1. When the ball 36 cooperates with the rectilinear portion h parallel to the axis of the shaft 18, the relative translation of the ring 31 and of the sleeve 28 no longer produces any rotational movement of the sleeve 28. This portion h constitutes a protection making it possible to absorb the surplus of the translational movement of the ring 31.

It is clear that there may be several ramps 29 and corresponding balls 36 regularly angularly interspaced at the periphery of the sleeve 28. Moreover, the balls 36 could be replaced by an equivalent member, such as a pin.

Figure 5:
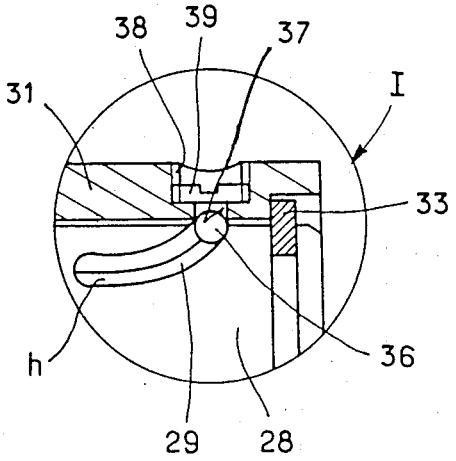
FIG. 5 is a detail in cross-section on an enlarged scale of the mechanical angular incrementation means of FIG. 4.

This being the case, the operation of the start-up means and of the incrementation means represented in FIGS. 4 and 5 is as follows.

The initial position is that represented in FIG. 4 wherein the pinion 1 is disengaged and separated from crown wheel 2.

Following a meshing command from the control means C (FIG. 1), the lever 15 drives the ring 31 in translation towards the crown wheel 2.

By means of the spring 32, the ring 31 pushes the sleeve 28 which drives the other sleeve 26, the cup 23 and the pinion 1 in translation towards the crown wheel 2.

If the teeth of the pinion 1 are not opposite the grooves of the crown wheel 2, the pinion 1 abuts this crown wheel during its translational displacement without being engaged. In other words, the translational travel of the pinion 1 and hence of the sleeve 28 will be shorter than that corresponding to engagement.

When the pinion 1 thus comes to bear against the crown wheel 2 without being engaged, the sleeve 28 can no longer advance in translation. The ring 31 which continues to be driven by the lever 15, will be displaced in translation relative to the sleeve 28 by compressing the spring 32.

During this relative movement of the ring 31 in relation to sleeve 28, the ball 36 cooperating with the ramp 29 produces a rotational movement of the sleeve 28 around its axis.

The freewheel 30 is arranged in such a way that this rotational movement of the sleeve 28, produced during the advance of the ring 31, is not transmitted to the pinion 1 by means of the sleeve 26.

After a travel of spring compression equal to distance represented in FIG. 4, the ring 31 abuts the distance flange 35 and can no longer continue its translational movement.

This situation is detected, as already explained above, by the sensor means comprising the electronic switching motor 7 at the actuating means A.

Following this indication, the control means C (FIG. 1) cause the ring 31 to withdraw in relation to the flange 35 by a distance slightly exceeding j to release the pinio from the crown wheel.

During this withdrawal, a reverse rotational movement of the sleeve 28 relative to the ring 31 is actuated. This rotational movement is transmitted by the freewheel 30, which is then in a locking state, to the sleeve 26 and hence to the pinion 1 which is thus subjected to an angular incrementation of a predetermined value.

The control means C again actuate an approaching movement of the pinion 1 towards crown wheel 2 by means of the lever 15.

A succession of stages similar to that described above takes place if the teeth of the pinion 1 again do not enter into the grooves of the crown wheel 2.

The angular incrementation is thus repeated until the teeth of the pinion are opposite the grooves of the crown wheel 2.

When, following this final incrementation, this position is reached during the next approaching movement actuated by the lever 15, the teeth of the pinion 1 will enter into the grooves of the crown wheel 2 free of shock and the pinion 1 will be able to complete the total travel in translation corresponding to a complete engagement. The sleeve 21 has accompanied this translational movement which has displaced the teeth 20 in relation to the teeth 19 of the shaft 18.

The detection of the complete engagement travel can also be ensured on the basis of the detection of the amplitude of rotation of rotor 9 of the motor 7.

When complete engagement has been detected, the control means C cause the actuating means A to stop and the lever 15 to be maintained in the position it occupies. Closing of the contactor 5 is actuated when the user demands a start by the contact key.

The shaft 18 is then driven in rotation by the electric starter motor. This rotational motion is transmitted to the sleeve 21 and, by the freewheel 24 which is in the locking state, to the pinion 1 which drives the crown wheel 2. On the other hand, this rotation is not transmitted to the sleeve 28 by the freewheel 30.

It should be noted that during the angular incrementation of the pinion 1, the freewheel 24 does not transmit these angular incrementations from pinion 1 to the sleeve 21.

Figure 6:
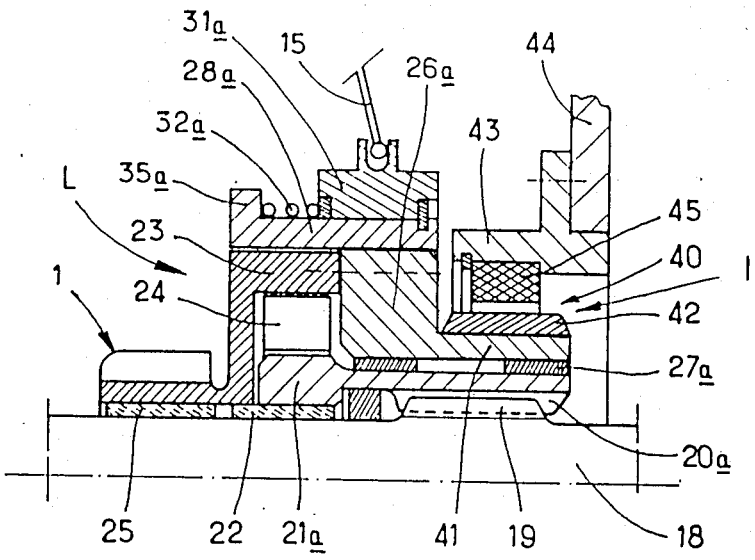
FIG. 6 is an axial half cross-section of the start-up means and of the electric angular incrementation means for the device of FIG. 1.

FIG. 6 of the drawings illustrates a variant of the embodiment of the start-up means associated with separate actuating means whilst the angular incrementation means of the pinion comprise an electric motor 40 of the electronic stepping type, or an equivalent device.

Those elements of the device represented in FIG. 6 which are identical to, or perform similar functions to, the elements already described with reference to FIG. 4, are designated by the same reference numerals, possibly followed by the letter a; their description is not repeated or at least not repeated in detail.

The ring 31*a* secured against rotation is mounted free for translation on the sleeve 28*a*. No provision is made for a means similar to the ramp 29 and the ball 36 shown in FIG. 5, between this ring 31*a* and the sleeve 28*a*. The spring 32*a* compressed between the ring 31*a* and the flange 35*a* allows a relatively smooth transmission of the forces.

The sleeve 28*a* is linked in translation and in rotation to the sleeve 26*a* and to the cup 23.

The sleeve 26*a* comprises on the side remote from the pinion 1 a cylindrical extension 41 with a relatively small external diameter constituting the rotor of the electric motor 40. This rotor can be of the type having permanent magnets 42 fixed to the external surface of this extension 41. The stator 43 of the electric motor 40 is fixed on a mounting 44 of the drive means D. The windings 45 of the stator 43 surround the magnets 42 at a small radial distance. The electric motor 40 is controlled by the control means C.

It should be noted that the freewheel 30, which was provided in FIG. 4, has been eliminated from the embodiment of FIG. 6.

The operation of the start-up and incrementation means of FIG. 6 is similar to that described with reference to FIGS. 4 and 5.

The axial translation of the pinion 1 towards the crown wheel (not shown in FIG. 6) is still actuated by the lever 15 which drives the ring 31*a*; the thrust force is transmitted by the spring 32*a* to the assembly comprising the pinion 1.

If the teeth of this pinion are not opposite the grooves of the crown wheel 2, the pinion 1 is stopped in its travel by coming to bear against the crown wheel. The sleeve 28*a* ceases to advance, whereas the ring 31*a* continues its movement compressing the spring 32*a* until it is stopped in its translation along the direction of the axis of the shaft 18.

As explained above, this stopping is detected at the motor 7 and the control means C cause the ring 31*a* to withdraw by an amount sufficient to release the pinion of the crown wheel and send an operating order to the motor 40, to produce an angular incrementation of a predetermined value, of the rotor 41 and hence of the sleeve 26*a*.

The angular incrementation is actuated in the direction of rotation wherein the freewheel 24 does not transmit the rotational motion to the sleeve 21*a* and to the shaft 18.

It should be noted that the control means C produce, both in the case of FIGS. 4 and 5 and in the case of FIG. 6, an axial withdrawal of this pinion 1 by a reverse operation of the actuating means A during a first period when the coming into contact of the pinion 1 with the crown wheel 2 has been detected. The angular incrementation would then, in particular in the case of FIG. 6, be actuated when the pinion 1 has been released from the crown wheel 2 so as to prevent any unwanted friction between the pinion and the crown wheel.

Figure 7:
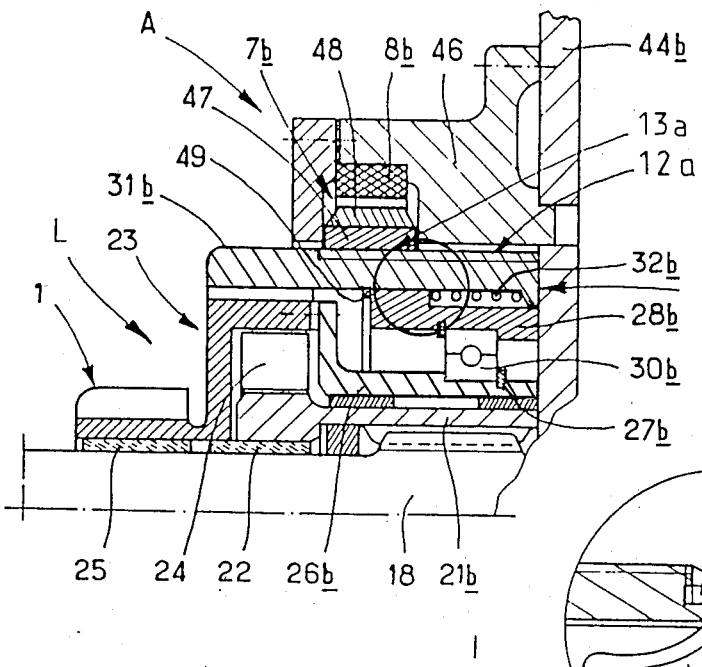
FIG. 7 is an axial half cross-section of the start-up means and of the mechanical angular incrementation means for the device of FIG. 2.
Figure 8:
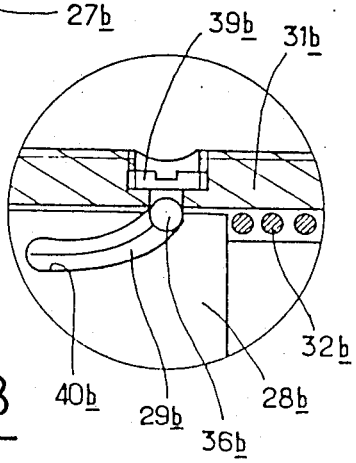
FIG. 8 is a detail in cross-section of the mechanical angular incrementation means of FIG. 7 on an enlarged scale.

FIG. 7 illustrates an embodiment in which, as in the diagram of FIG. 2, the actuating means are incorporated with the start-up means, the angular incrementation means I according to FIGS. 7 and 8 being of the mechanical type, as in the case of FIGS. 4 and 5.

Those elements of the device represented in FIGS. 7 and 8 which are identical to, or perform similar functions to, the elements already described with reference to the preceding Figures are designated by the same reference numerals, possibly followed by the letter b without their description being repeated or at least not repeated in detail.

As may be seen in FIG. 7, the actuating means A comprise an electric motor 7*b* with electronic switching whose stator body 46 is fixed to the mounting 44*b* of the drive means. The rotor 47 of this motor is constituted by an internally threaded ring forming a nut on whose periphery, the permanent magnets 48 are fixed. This rotor 47 is secured against translation along the axial direction but is free for rotation. The windings 8*b* of the stator surround the rotor 47 at a short spacing.

The ring 31*b*, whose length along the axial direction is greater than in the case of FIGS. 4 and 6, comprises on its external surface a thread capable of being screwed into the rotor 47. This ring 31 is secured against rotation but is capable of displacement in translation.

The sleeve 28*b* is slidably mounted within the ring 31*b*. The spring 32*b* is mounted both around a portion of the sleeve 28*b* with a smaller external diameter, and also within the ring 31*b*. This spring 32*b* bears at one end, facing the pinion 1 against an outwardly projecting radial shoulder on the sleeve 28*b*; at its other end, the spring 32*b* bears axially against an internal radial shoulder of the ring 31*b*. The sleeve 28*b* is urged by the spring 32*b* against an elastic split ring 49 anchored in an annular groove provided on the internal surface of the ring 31*b*.

As in FIG. 5, the angular incrementation means I, reprsented in detail in FIG. 8, comprise at least one inclined ramp 29*b* provided on the larger diameter external surface of the sleeve 28*b* and a ball or equivalent 26*b* capable of cooperating with this ramp or groove 29*b*, the ball 36*b* being carried by the internal surface of the ring 31*b*.

The sleeve 28*b* is mounted on the other sleeve 26*b* by means of the freewheel 30*b*.

The operation of the start-up means and of the actuating means of FIGS. 7 and 8 follows directly from the preceding explanations.

The advancing movements in axial translation towards the crown wheel 2 (not shown in FIG. 7) is obtained by causing the motor 7*b* to operate. The rotation of the rotor 47 produces, by the effect of the screw/nut system, a translational movement of the ring 31*b* towards the crown wheel. This ring drives the sleeve 28*b*, and hence the pinion 1, in translation by means of the spring 32*b*.

If this pinion 1 abuts the crown wheel 2 without meshing engagement, the sleeve 28*b* ceases to advance whilst the ring 31*b* continues its movement compressing the spring 32*b* still further.

The cooperation of the ball 36*b* and of the ramp 29*b* produces a rotation of the sleeve 28*b* which rotation is not transmitted by the free wheel 30*b* to the sleeve 26*b*.

When the ring 31*b* comes to the end of its travel, the rotor 47 cannot rotate any further in response to the pulses sent into the windings of the stator 8*b*. This situation is detected and the control means C cause the ring 31*b* to withdraw until the ring 49 again abuts the transverse end face of the sleeve 28*b*.

During this translational withdrawal movement, the sleeve 28*b* effects a rotation in an opposite direction to that effected previously, as a result of the cooperation of the ball 36*b* and of the ramp 29*b*. This rotation is transmitted to the sleeve 26*b* and to the pinion 1 and corresponds to one incremental angular step.

The free wheel 24 does not transmit this rotation to the sleeve 21*b* and to the shaft 18.

When the teeth of the pinion 1 come to be opposite the grooves of the crown wheel 2, complete meshing engagement will have been obtained and the control means C will be ready to start the starter means D to drive the shaft 18 in rotation, this being so irrespective of the embodiment adopted.

Figure 9:
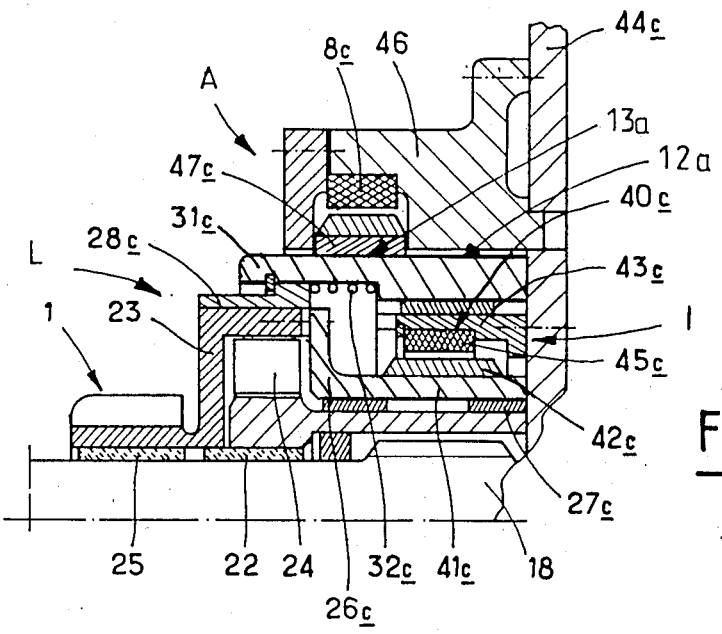
FIG. 9 is an axial half cross-section of the start-up means and of the electric angular incrementation means for the device of FIG. 2.

FIG. 9 shows an embodiment for a starting unit S according to the diagram of FIG. 2 wherein the actuating means are incorporated with the start-up means, as in the case of FIG. 8, whilst the incrementation means comprise an electric motor as in the case of FIG. 6.

Those elements of the device represented in FIG. 9 which are identical to, or perform similar functions to, the elements already described with reference to the preceding Figures are designated by the same reference numerals, possibly followed by the letter c without their description being repeated or at least not repeated in detail.

To ensure the angular incrementation for the pinion 1, the electric motor 40*c* comprises a rotor constituted by the extension 41*c* of the sleeve 26*c* on which extension the permanent magnets 42*c* are mounted. The stator 43*c* is fixed to the mounting 44*c* of the drive means, the stator windings 45*c* surrounding the rotor.

The operation of the device shown in FIG. 9 is deduced from the explanations given above.

The advancing movement of the ring 31*c* is obtained, as explained with reference to FIG. 7, by the rotation of the rotor 47*c* whose internal thread cooperates with the external thread of the ring 31*c*. The thrust is transmitted by the spring 32*c* to the sleeve 28*c*, to the cup 23, and to the pinion 1.

When the abutment of the pinion 1 against the crown wheel (not shown in FIG. 9) has been detected, the control means C cause the ring 31*c* to withdraw and start the motor 40*c* to produce an angular incrementation of a predetermined amplitude for pinion 1. As already explained, this incrementation is repeated until the teeth of the pinion 1 are opposite the grooves of the crown wheel, to allow a complete shock free meshing engagement.

Figure 10:
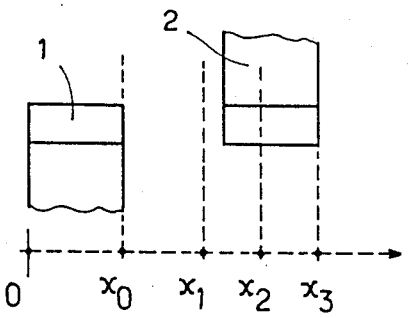
FIG. 10 is a diagram to explain the meshing stage of the pinion and of the crown wheel.

FIG. 10 of the drawings is a diagram giving a partial summary representation of the pinion 1 and of the crown wheel. The successive positions in translation of the pinion 1 along the direction parallel to the axis of pinion 1 are identified by the abscissae x0, x1, x2 in relation to an origin 0 of the face of the pinion 1 turned towards the crown wheel 2. Abscissa x3 is assigned to the side of crown wheel 2 which is remote from the pinion 1.

This diagram of FIG. 10 will be used a little further on to explain an engagement sequence.

FIG. 11 represents schematically the control means C comprising an electronic module 50, in particular a microprocessor, arranged or programmed to execute the functions set out in this description.

This module 50 receives several data inputs, some of which have already been mentioned with regard to the line 11 to the electronic stepping motor 7 and with regard to the detector 4 sensing the rotational speed of the internal combustion engine. A line 51 allows information to be fed to the module 50 regarding the open or closed state of the general contact switch 52 of a vehicle equipped with the starting device in accordance with the invention. This contact 52 corresponds to the conventional ignition/starter switch which is closed when acting on the contact key.

Another line 53 introduces an input indicating the presence or absence of a starting command according as to whether the contact 54 is closed or open. This contact 54 generally corresponds to an intermediate position of the ignition key when the engine of the vehicle is being started.

Line 55 introduces an input regarding the temperature of the drive means D, which temperature is detected for instance, by a temperature sensor 56 mounted in the drive means.

On the basis of these inputs, the electronic module 50 generates the respective output signals for the actuating means A, these signals being delivered on the line $1_A$ connected to the phases of the motor (see also FIG. 1), and control signals delivered on line $1_5$ for the contactor 5.

In the embodiments of FIGS. 6 and 10, where the angular incrementation means I comprise an electric motor of the electronic switching type or an equivalent device, a line 57, for example with three conductors, similar to line 11 supplies inputs to the module 50 regarding the position of the rotor of the motor 40 or 40*c*.

The lines 58 transmit the phase control signals from the module 50 to the motor 40, or 40*c* of FIGS. 6 or 9.

Line 59 transmits a control signal actuating an indicator.

Preferably, the module 50 is arranged so as to actuate a rapid advance of the pinion 1 from x0 to x1 (see FIG. 10), then a slow advance for the engagement stage from x1 to x2. The abscissae of the position occupied by the pinion 1 can be deduced from the angular amplitude of rotation of the electronic switching motor such as 7, at the actuating means A for commanding the translational displacement of the pinion.

This being the case, the arrangement of the module 50 (in the case of a microprocessor, the arrangement will essentially lie in the programming of this microprocessor) advantageously provides for the completion of one starting sequence of the internal combustion engine as explained below.

The initial state corresponds to a zero speed of the internal combustion engine and an arrest of the pinion 1 which is completely engaged, that is to say, adopting the representation of FIG. 10, the x abscissa of the face of the pinion nearer the crown wheel 2 is equal to x3.

If the driver of the vehicle fitted with an internal combustion engine comprising such a starting device, closes the contact 54 (FIG. 11) which corresponds to a starting command, the module 50 sends on line $1_5$ a signal capable of closing the contactor 5 and hence the energisation of the drive means D (FIGS. 1 and 2).

When the rotational speed of the internal combustion engine detected by the sensor 3 (FIG. 11) exceeds a predetermined value (for instance, 500 rpm), the electronic module 50 causes the signal to stop which is sent on the line $1_5$ so as to produce the opening of the contactor 5 and the stopping of the drive means D. Moreover, the disengagement of the pinion 1 in relation to the crown wheel 2 is actuated by a rapid withdrawal of this pinion. This disengagement is obtained by means of the control signal sent by the module 50 on the lines $1_A$ to the actuating means A so that the motor 7 turns in the appropriate direction and speed to cause the pinion 1 to withdraw rapidly. The pinion therefore passes from the position of abscissa x3 (FIG. 10) to the position of abscissa x0. The module 50 causes the actuating means A and hence of the pinion 1 to stop when the pinion has reached the abscissa x0.

As explained above, the starter means D remain energised until the rotational speed of the internal combustion engine attains a predetermined value. However, a limitation of the period of this power supply is imposed by the transducer 56 responsive to the temperature of the starter means D.

Throughout the operation of the internal combustion engine, the pinion 1 remains in the abscissa position x0.

When the internal combustion engine stops (irrespective as to whether it is an intentional stop or stalling) the detector 4 sends a zero speed input to the module 50. The module 50 sends an output signal on the line $1_A$ to cause the actuating means A to operate so that the pinion 1 advances rapidly as far as the abscissa x1 (FIG. 10).

From this abscissa (detected as explained above in response to the number of turns of the rotor of the electronic switching motor 7), the module 50 oprders a slow advance of the pinion 1 towards the crown wheel 2.

If the teeth of the pinion 1 are not opposite the grooves of the crown wheel 2, which is the condition for meshing engagement, the pinion 1 abuts this crown wheel 2 as explained above.

The module 50 orders a rapid withdrawal of the pinion 1 as far as the abscissa position x1, and an angular incrementation of this pinion 1 is produced, as has also been explained above.

The module 50 orders a new slow advance from the position x1 towards the crown wheel 2. This operation of angular incrementations is repeated until meshing engagement is obtained.

The slow advance continues as far as the abscissa position x2.

The module 50 then orders a rapid advance to complete the engagement as far as the abscissa position x3.

The translation of pinion 1 is then stopped.

The engagement sequence is completed and the unit is ready to respond immediately to the next fresh starting command corresponding to the closing of the contact 54.

Thus, irrespective of the embodiment adopted, the starting unit in accordance with the invention makes it possible to obtain an automatic meshing engagement either by a mechanical device as in the case of FIGS. 4 and 7 or by an electromechanical device as in the case of FIGS. 6 and 9.

The wear of the pinion and of the crown wheel is limited to a considerable extent because engagement of the pinion 1 with the crown wheel is only effected when the teeth of the pinion are opposite the grooves of the crown wheel.

The pre-positioning or pre-engagement of the pinion in the crown wheel when the engine has stopped, allows faster starting of this engine because, when the starting order is given, the engagement sequence has already been effected.

The device of the invention oonsiderably reduces the noise during starting and even during the engagement.

The physical separation, in accordance with the invention, of the contactor 5 controlling the drive means in relation to the actuating means provides great flexibility for locating the contactor 5, independently of the location of the actuating means A. This also entails good mastery in the control of the drive means D.

The electronic module 50 of the control means C protects the starter means D, in particular against incorrect operations, against excessive speed, and against overheating (thermal protection).

In general, the starting unit in accordance with the invention, makes it possible to obtain an improvement in the kinematic chain, a reduction in weight and bulk, and an operational diagnosis.

The relief of the kinematic chain is particularly noticeable when the actuating means A are incorporated with the start-up means L in the general diagram of FIG. 2 and the embodiments of FIGS. 7 and 9.

As regards the thermal protection of the drive means D, it should be noted that instead of using a temperature transducer 56 as explained above, one can keep a time check of the operating period of the drive means and deduce the temperature of these means from their period of operation.

The starting device in accordance with the invention, intended primarily for internal combustion engines for motor vehicles, is particularly suitable for vehicles whose engine operates on a stop-go basis. It will be recalled that in such vehicles, the internal combustion engine is stopped each time the vehicle is stopped and the engine is restarted each time the user wishes to move off again; the object of such stop-go systems is to allow considerable energy savings to be obtained in urban vehicle traffic where there are many stoppage due, for instance, to traffic lights or traffic jams.

It is clear that many variants of the embodiments are possible for the various means of the starting device in accordance with the invention. In particular, the sensor means could be constituted by force transducers or equivalent devices sensing the bearing contact of the pinion against the crown wheel.

We claim:

1. In a starting unit for an internal combustion engine comprising:

start-up means for the engine which comprise engagement means capable of being displaced in translation for meshing engagement in complementary receiving means linked in rotation to the internal combustion engine, and of being released therefrom;

actuating means for displacing said engagement means in translation, said actuating means comprising a rotary drive source and motion transformation means for transforming a rotational motion into a translational motion;

and drive means for driving the start-up means in rotation to drive the associated internal combustion engine when the engagement means are in engagement with said complementary receiving means;

the improvement comprising:

sensor means sensing the relative position of said engagement means and of said complementary receiving means;

angular incrementation means capable of causing the engagement means to rotate in relation to the receiving means by a predetermined amplitude; and control means responsive to the sensor means and capable of, on the one hand, limiting the translational movement of the engagement means when it is apparent that they are not in a correct position for meshing engagment with the receiving means and for effecting an angular incrementation in that event and, on the other hand, ensuring the engagement of the engagement means with the receiving means when a correct position is reached and only when starting the drive means when start-up of the internal combustion engine is desired by the user;

said control means further being capable of producing a withdrawal of said engagement means relative to said receiving means and of producing a new advance of said engagement means after a relative angular incrementation between said engagement means and said receiving means.

2. A starting unit according to claim 1, including means sensing the operation of the internal combustion engine and combined with said control means for actuating the engagement of the engagement means and of the complementary receiving means only when stopping of the internal combustion engine has been detected.

3. A starting unit according to claim 2, wherein said sensing means comprise a detector responsive to the rotational speed of the internal combustion engine.

4. A starting unit according to claim 2, wherein the control means are effective to stop the drive means when the rotational speed of the internal combustion engine exceeds a predetermined value.

5. A starting unit according to claim 1, wherein the drive means are adapted to be started by a contactor which is subject to the influence of the control means independently of the actuating means.

6. A starting unit according to claim 1, further comprising means for limiting the temperature of the drive means.

7. A starting unit according to claim 1, wherein the engagement means comprise a pinion, wherein the receiving means comprise a crown wheel having grooves capable of receiving the teeth of said pinion, and wherein the sensor means comprise means sensing the coming into contact of the teeth of the pinion against the crown wheel during the approach movement when the teeth of the pinion are not located opposite the grooves of the crown wheel.

8. A starting unit according to claim 7, wherein said means sensing the coming into contact of the teeth of the pinion against the crown wheel are constituted by said rotary drive source of the actuating means.

9. A starting unit according to claim 8, wherein said rotary drive source means comprise an electronic switching motor.

10. A starting unit according to claim 7, wherein said angular incrementation means are formed by a mechanical system of the inclined ramp and ball type, including a sleeve having an external surface on which the inclined ramp is provided, said sleeve being accommodated within a ring and being capable of displacement in translation in relation to said ring, against resilient means whilst the ball is carreid inside the ring, and including a freewheel linking said sleeve rotation to the opinion by and capable of transmitting the rotational movement from the sleeve to the pinion when the ring is withdrawn.

11. A starting unit according to claim 7, wherein the angular incrementation means are constituted by an electric motor of the electronic switching type, having a stator joined to the mounting of the drive and a rotor linked in rotation and in translation to the pinion.

12. A starting unit according to claim 1, wherein the means transforming the rotational motion of the rotary drive source into a translational motion comprise a screw and nut system having first and second elements, said first element being driven in rotation whilst remaining secured against translation relative to the rotary drive source whilst the second element is secured against rotation and free from translation relative to the rotary drive source.

13. A starting unit according to claim 1, wherein said actuating means are separate from the start-up means, and a mechanical linkage system is provided for transmitting the translational motion established by the actuating means to the start-up means.

14. A starting unit according to claim 13, wherein said mechanical linkage system is a fork and lever linkage.

15. A starting unit according to claim 1, wherein said actuating means are incorporated with the start-up means, and wherein said rotary drive source of the actuating means are constituted by an electronic switching motor having a stator fixed to the mounting of the drive means and a rotor which is free for rotation but secured against translation in relation to this mounting and forms a nut with an internal thread capable of cooperating with the external thread of a ring secured against rotation but free for translation.

16. A starting unit according to claim 1, wherein the control means are constituted by an electronic module capable of providing control signals according to the various data inputs received.

17. A starting unit according to claim 16, wherein said electronic module is a microprocessor.

* * * * *